US011463802B2

(12) United States Patent
Chen

(10) Patent No.: US 11,463,802 B2
(45) Date of Patent: Oct. 4, 2022

(54) VIBRATION SYSTEM OF ULTRA-THIN FULL-RANGE LOUDSPEAKER

(71) Applicant: Tymphany Worldwide Enterprises Limited, Huizhou (CN)

(72) Inventor: ZhiWen Chen, Huizhou (CN)

(73) Assignee: Tymphany Worldwide Enterprises Limited, Huizhou (CN)

( * ) Notice: Subject to any disclaimer, the term of this patent is extended or adjusted under 35 U.S.C. 154(b) by 0 days.

(21) Appl. No.: 16/668,452

(22) Filed: Oct. 30, 2019

(65) Prior Publication Data

US 2020/0186914 A1 Jun. 11, 2020

(30) Foreign Application Priority Data

Dec. 7, 2018 (CN) ..... 201822052085.4

(51) Int. Cl.

| | |
|---|---|
| ***H04R 25/00*** | (2006.01) |
| ***H04R 1/28*** | (2006.01) |
| ***H04R 7/04*** | (2006.01) |
| ***H04R 9/06*** | (2006.01) |

(52) U.S. Cl.
CPC ..... *H04R 1/2811* (2013.01); *H04R 7/04* (2013.01); *H04R 9/06* (2013.01)

(58) Field of Classification Search
CPC ..... H04R 1/2811; H04R 7/04; H04R 9/047; H04R 9/06; H04R 1/06
USPC ..... 381/345
See application file for complete search history.

(56) References Cited

U.S. PATENT DOCUMENTS 9,894,442 B2 * 2/2018 Salvatti ..... H04R 9/06

* cited by examiner

*Primary Examiner* — Phylesha Dabney
(74) *Attorney, Agent, or Firm* — Finnegan, Henderson, Farabow, Garrett & Dunner, LLP

(57) ABSTRACT

A vibration system of an ultra-thin full-range loudspeaker includes a diaphragm and frameless winding voice coils directly attached to the diaphragm. Each frameless winding voice coil is a planar coil formed by winding a single enameled wire. Each planar coil is of a racetrack or an annular shape and the enameled wires are arranged by tightly contacting to each other. According to the vibration system, the frameless winding voice coils are directly attached to the diaphragm, and lead wires of the voice coils are tightly arranged, so that a space utilization rate in a magnetic gap is effectively improved, so as to improve a driving force factor BL and an output sensitivity.

12 Claims, 3 Drawing Sheets

2A series connection manner 2B parallel connection manner

VIBRATION SYSTEM OF ULTRA-THIN FULL-RANGE LOUDSPEAKER

CROSS REFERENCE TO RELATED APPLICATIONS

This application claims priority to CN 201822052085.4, which was filed on Dec. 7, 2018, and which is herein incorporated by reference.

TECHNICAL FIELD

The present invention relates to the technical field of manufacturing a loudspeaker, and in particular to a vibration system of an ultra-thin full-range loudspeaker.

BACKGROUND

At present, various electronic products such as an ultra-thin television and a portable sound box have pushed forward a requirement on the thickness. Concerning a product structure of a loudspeaker, a high-performance ultra-thin full-range loudspeaker having a smaller thickness is also required.

For the existing full-range loudspeaker, a vibration system includes a diaphragm and flexible voice coils prepared with a printing-etching process. The printed voice coils have the advantage of freedom of wiring the lead wires to form the routing layout with various complex shapes. However, the voice coils also have the following defects: (1) the printed voice coils must take a flexible insulating planar thin film as a base material and the base material is used as a carrier for printing the voice coils and also forms one part of the vibration system of the loudspeaker, so as to increase inevitably the thickness and the vibration mass, and to reduce an output sensitivity; and (2) while wiring the printed voice coils, a certain space between the lead wires is necessary to prevent the short circuit, and a thickness of each lead wire is usually very small and merely several common specifications are provided, so that a thickness adjustment of each lead wire is greatly limited. That is, the cross section of a single lead wire for allowing a current passing through is limited, which determines that the flexible printed voice coils cannot bear a very high input power.

Therefore, it is necessary to optimize the vibration system of the above-mentioned full-range loudspeaker to improve the output sensitivity of the full-range loudspeaker.

SUMMARY

In order to solve the above-mentioned problems of the prior art, the present invention provides a vibration system of an ultra-thin full-range loudspeaker. According to the vibration system, frameless winding voice coils are directly attached to a diaphragm, and lead wires of the voice coils are arranged tightly to each other, so that a space utilization rate in a magnetic gap is effectively improved, and a driving force factor BL and an output sensitivity are improved.

To achieve aforesaid purposes, the present invention provides the following technical solution.

A vibration system of an ultra-thin full-range loudspeaker includes a diaphragm and frameless winding voice coils directly attached to the diaphragm, where each frameless winding voice coil is a planar coil formed by winding a single enameled wire, and the enameled wires are arranged by tightly contacting to each other.

Each frameless winding voice coil is formed by winding the single enameled wire. As surfaces of the enameled lead wires are insulated, the enameled wires can be arranged by tightly contacting to each other. In this way, a space utilization rate in a magnetic gap is improved to a great extent so as to improve the driving force factor BL (magnetic coefficient) of the loudspeaker. Additionally, since such winding voice coils do not require a bobbin, and a plane of each winding voice coil can be directly attached to the diaphragm, so that the unnecessary weight can be reduced. The ultra-thin property of the full-range loudspeaker is further ensured, and also an output sensitivity of the loudspeaker is improved.

As a further description for the technical solution of this invention, each planar coil is in a shape of a racetrack or an annularity, or other shapes as required by the design.

As a further description for the technical solution of this invention, when two or more frameless winding voice coils are used simultaneously, the frameless winding voice coils are connected in a series connection or parallel connection manner. The two or more frameless winding voice coils are connected in the series connection or parallel connection manner, and are also attached to the diaphragm to drive the diaphragm vibrating and generating sounds, so that the mechanical stroke is ensured.

As a further description for the technical solution of this invention, when two or more frameless winding voice coils are used simultaneously, the frameless winding voice coils are placed horizontally in parallel, or placed by overlapping up and down, or arranged in any other manner as required by the design.

As a further description for the technical solution of this invention, the enameled wire of each frameless winding voice coil has a thickness and a wideness in a range of 0.05 mm to 0.5 mm.

As a further description for the technical solution of this invention, the enameled wire of each frameless winding voice coil is a flat wire or a rounded wire.

As a further description for the technical solution of this invention, each enameled wire is a copper wire, an aluminum wire or a copper-clad aluminum wire.

In the vibration system provided by the present invention, the enameled lead wires of the frameless winding voice coils are the flat wires each having a thickness of 0.4 mm thick and a width of 0.2 mm, the enameled lead wires are arranged closely, and a plurality turns of lead wires (e.g., eighteen turns of lead wires) can be arranged in one single magnetic gap, so that the magnetic energy in the magnetic gap can be more sufficiently utilized. The vibration system may further use voice coil wires of other specifications. In this way, the bearing power is not limited by a carrying current of a cross section of lead wires such as flexible printed voice coils.

The present invention further provides an ultra-thin planar magnetic diaphragm full-range loudspeaker including the above-mentioned vibration system. Compared the ultra-thin planar magnetic diaphragm full-range loudspeaker with the conventional moving coil type loudspeaker, it has better power tolerance and better heat dissipation property of the planar structure.

Based on aforesaid technical solutions, the invention achieves the following technical effects:

(1) According to the vibration system of the ultra-thin full-range loudspeaker provided by the invention, the frameless winding voice coils are directly attached to the diaphragm, and the enameled wires are arranged by tightly contacting to each other, that a space utilization rate in the magnetic gap is effectively improved, so as to improve the driving force factor.

(2) According to the vibration system of the ultra-thin full-range loudspeaker provided by the invention, the winding voice coils do not require a bobbin, and a plane of each winding voice coil can be directly attached to the diaphragm, so that the unnecessary weight is reduced, the ultra-thin property of the full-range loudspeaker is further ensure, and the output sensitivity of the loudspeaker is improved.

(3) The ultra-thin planar magnetic diaphragm full-range loudspeaker including the above-mentioned vibration system has uniform stress applied on the diaphragm, good power tolerance, heat dissipation property, and can be widely utilized on a thin electronic device.

DETAILED DESCRIPTION OF THE EMBODIMENTS

In order to understand the present invention conveniently, this invention will be described more thoroughly in conjunction with the accompanying drawings and specific embodiments. Preferred implementation manners of this invention are given in the accompanying drawings. However, this invention may be implemented in many different forms and is not limited to the implementation manners described herein. Reversely, the purpose of providing these implementation manners is to understand the contents of the invention more thoroughly and comprehensively.

It is to be noted that when an element is referred to as being "fixed on" another element, it may be directly on the other element or an intervening element may also be present. When one element is considered as being "connected to" the other element, it may be directly connected to the other element or an intervening element may also be present.

For the ease of reading, the "upper", "lower", "left" and "right" indicated according to the accompanying drawings are merely for indicating a relative reference position of each element and are not intended to limit the present invention.

Unless otherwise defined, all technical and scientific terms used herein have the same meaning as commonly understood by a person skilled in the art to which the invention belongs. Terms used herein in the specification of the invention are merely for describing the specific implementation manners but are not intended to limit the invention.

Embodiment 1

Figure 1:
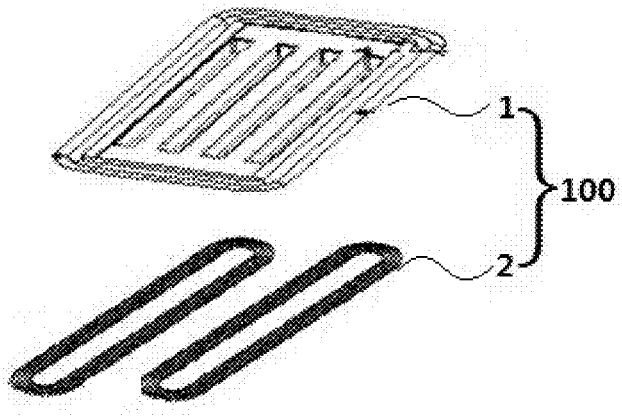
FIG. 1 is an exploded diagram of a vibration system of an ultra-thin full-range loudspeaker according to the present invention.

FIG. 1 is a structural exploded diagram of a vibration system of an ultra-thin full-range loudspeaker in this embodiment. As shown in FIG. 1, the vibration system 100 of the ultra-thin full-range loudspeaker includes a diaphragm 1 and frameless winding voice coils 2, wherein the frameless winding voice coils 2 can be directly attached to the diaphragm 1 without preforming a connection through a substrate during the attachment process. It is to be noted that each frameless winding voice coil is formed by winding a single enameled wire and has a racetrack shaped planar coil structure in this embodiment. Certainly, each frameless winding voice coil may also be in an annular shape or other shapes according to design requirements.

In the frameless winding voice coils, since surfaces of the enameled (lead) wires are insulated, the enameled wires can be arranged by tightly contacting to each other. In this way, the space utilization rate in a magnetic gap is improved greatly, and the driving force factor BL (magnetic coefficient) of the loudspeaker is improved.

Figure 2:
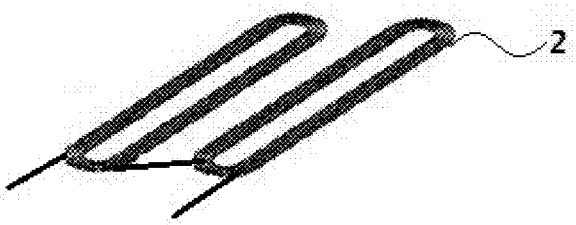
FIG. 2 is a connection schematic diagram of a frameless winding voice coil according to the present invention.
Figure 2:
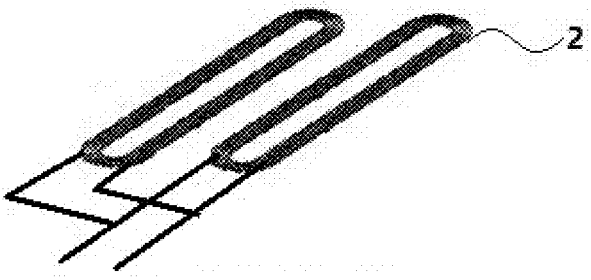

FIG. 2 is a connection schematic diagram of a frameless winding voice coil in this embodiment. As shown in FIG. 2, in this embodiment, the vibration system uses two frameless winding voice coils, wherein the frameless winding voice coils can be connected in a series connection manner marked as 2A, and can also be connected in a parallel connection manner marked as 2B. Certainly, when multiple frameless winding voice coils are connected, the series connection or parallel connection can also be used. The frameless winding voice coils connected together in the series connection or parallel connection manner are attached to the diaphragm, so as to together drive the diaphragm vibrating and generate sounds, so that the mechanical stroke of the loudspeaker is ensured.

It is further to be noted that when two or more frameless winding voice coils are used simultaneously, the frameless winding voice coils are arranged horizontally in parallel, arranged by overlapping up and down, or arranged in any other manner according to design requirements.

Figure 3:
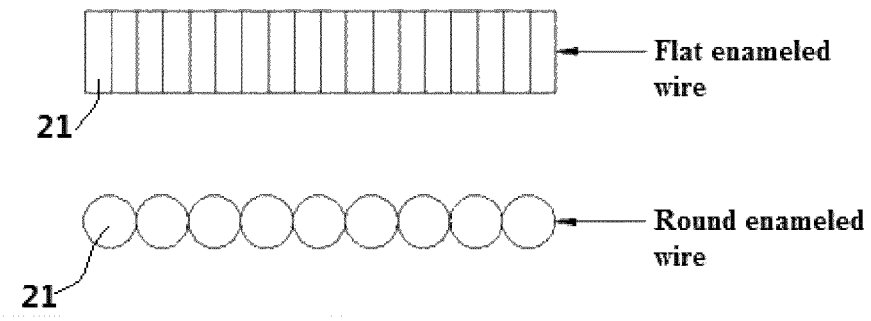
FIG. 3 is an arrangement schematic diagram of an enameled wire of a frameless winding voice coil according to the present invention.
Figure 4:
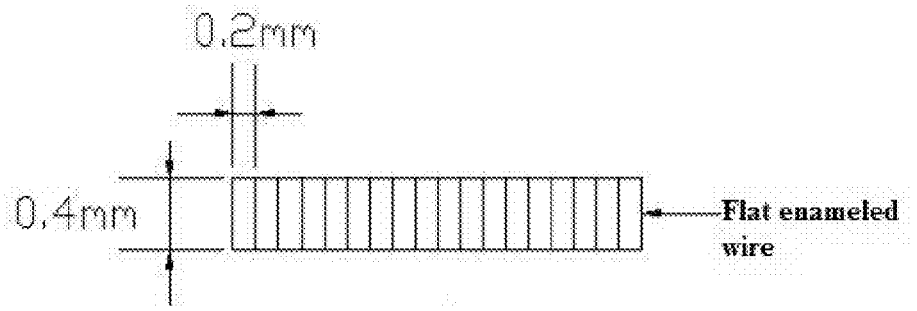
FIG. 4 is a structural schematic diagram of an enameled wire of a frameless winding voice coil according to the present invention.

FIG. 3 and FIG. 4 are an arrangement schematic diagram and a structural schematic diagram of an enameled wire of a frameless winding voice coil in this embodiment. Referring to FIG. 3 and FIG. 4, the enameled wire 21 of each frameless winding voice coil can use a flat enameled wire or a round enameled wire, and can be made of a copper wire, an aluminum wire or a copper-clad aluminum wire. It is to be noted that the enameled wires of the frameless winding voice coils are arranged by contacting closely whether shapes or materials of the enameled wires are adopted. That is, the vibration system provided by this embodiment, there are various specifications of the voice coils enameled wires can be selected. In this way, the bearing power is not limited by a carrying current of a cross section of lead wires such as flexible printed voice coils.

In this embodiment, the pure aluminum flat enameled wires are preferably selected for winding. It can be shown in FIG. 3, an arrangement of the flat enameled wires is more close than that of the round enameled wires and has less duty ratio, so that a maximum utilization rate of a magnetic gap space can be achieved. Moreover, the aluminum voice coils have a lighter weight to effectively reduce the mass of the voice coils and increase an output sensitivity.

Figure 5:
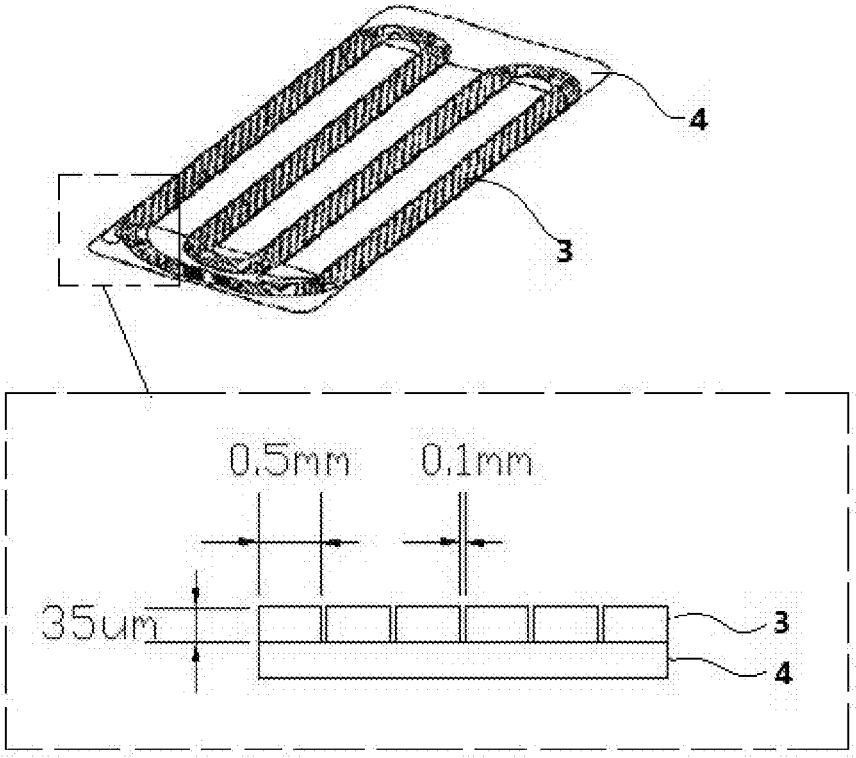
FIG. 5 is a structural schematic diagram of a flexible printed voice coil and a substrate.

For the sake of comparison, FIG. 5 is a structural schematic diagram of a flexible printed voice coil and a substrate. As shown in FIG. 5, the flexible printed voice coils 3 are required to be attached in the substrate 4 first and then attached to a diaphragm as a whole. In the flexible printed voice coils shown in FIG. 5, each lead wire has a thickness of 35 μm and a width of 0.5 mm, and a distance between the lead wires is 0.1 mm. In this way, only six turns of lead wires can be applied into a single magnetic gap, so that a sensitivity test result of a loudspeaker sample using the flexible printed voice coils is 79 dB (1 m/1 W). The ground of a lower sensitivity is that the printed voice coils must take a flexible insulating flat diaphragm as a base material. The base material also forms a part of the vibration system of the loudspeaker as a carrier of the printed voice coils, and thus a vibrating mess is increased inevitably and an output sensitivity is reduced.

Referring to FIG. 4 again, which shows a structural schematic diagram of an enameled wire of a frameless winding voice coil, the lead wire of each voice coil is the flat wire having a thickness and width in a range from 0.05 mm to 0.5 mm. An embodiment of the flat wire of each voice coil has a thickness of 0.4 mm and a width of 0.2 mm. The lead wires are arranged closely. There are a plurality of turns of lead wires (e.g., eighteen turns of lead wires) which can be arranged into a single magnetic gap, so that the magnetic energy in the magnetic gap can be sufficiently utilized. A sensitivity test result of a loudspeaker sample using such frameless winding voice coils is 84 dB (1 m/1 W). In a same magnetic circuit design, the driving force factor BL of the loudspeaker using the frameless winding voice coils is three times the driving force factor BL of the loudspeaker using the flexible printed voice coils.

Figure 6:
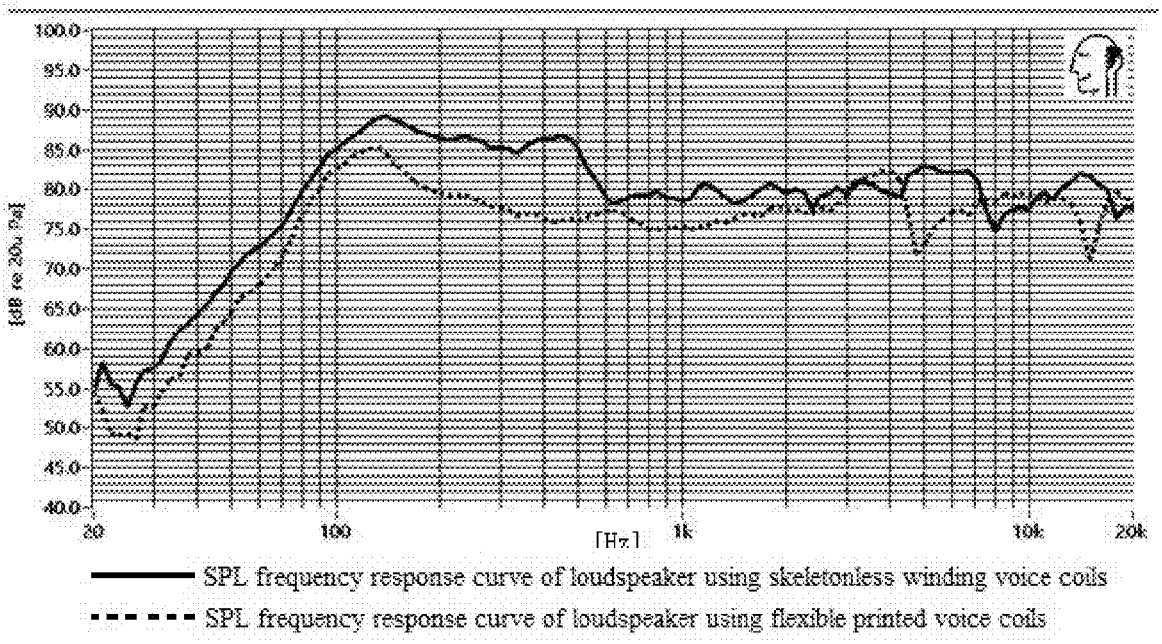
FIG. 6 is a Sound Pressure Level (SPL) frequency response curve diagram of a loudspeaker using a frameless winding voice coil and a loudspeaker using a flexible printed voice coil.

FIG. 6 is an SPL frequency response curve diagram of a loudspeaker using the frameless winding voice coils and a loudspeaker using the flexible printed voice coils. As shown in FIG. 6, it is similar to an SPL frequency response curve of the loudspeaker using the flexible printed voice coils, the effective frequency domain of the SPL frequency response curve of the loudspeaker using the frameless winding voice coils is wide (180-20 KHz), and the SPL curve is smooth.

According to the vibration system of the ultra-thin full-range loudspeaker provided by this embodiment, the frameless winding voice coils are directly attached to the diaphragm, and the enameled wires are arranged by tightly contacting to each other, so that a space utilization rate in the magnetic gap is effectively improved and the driving force factor is improved. Meanwhile, a bobbin for winding the voice coils is unnecessary, and a plane of each winding voice coil can be directly attached to the diaphragm, so that the unnecessary weight is reduced. The ultra-thin property of the full-range loudspeaker is further ensured, and an output sensitivity of the loudspeaker is improved.

The ultra-thin planar magnetic diaphragm full-range loudspeaker including the above-mentioned vibration system has uniform stress applied on the diaphragm, has good power tolerance and heat dissipation property, and can be widely applied to a thin electronic device.

The above contents are merely examples and explanations for the structure of the invention, and the description is specific and detailed but cannot be understood as a limit to the patent scope of the invention thereto. It is to be noted that those of ordinary skill in the art may further make a plurality of variations and improvements without departing from the concept of the invention and these obvious replacement forms all pertain to the protection scope of the invention.

What is claimed is:

1. A vibration system of an ultra-thin full-range loudspeaker, comprising:

a diaphragm; and frameless winding voice coils directly attached to the diaphragm, wherein each frameless winding voice coil includes a planar coil formed by winding a single enameled wire to provide a plurality of windings, wherein each of the plurality of windings directly contacts at least one other winding among the plurality of windings, and wherein the single enameled wire used to form the planar coil of each frameless winding voice coil is a flat wire, and in a cross-section perpendicular to a plane of the diaphragm, a width of the flat wire is less than a thickness of the flat wire.

2. The vibration system of the ultra-thin full-range loudspeaker according to claim 1, wherein each planar coil is in a shape of a racetrack or an annularity.

3. The vibration system of the ultra-thin full-range loudspeaker according to claim 1, wherein when two or more of the frameless winding voice coils are used simultaneously, the two or more of the frameless winding voice coils are connected in a manner of series connection or parallel connection.

4. The vibration system of the ultra-thin full-range loudspeaker according to claim 1, wherein when the two or more of the frameless winding voice coils are used simultaneously, the two or more of the frameless winding voice coils are arranged horizontally in parallel, or arranged by overlapping up and down.

5. The vibration system of the ultra-thin full-range loudspeaker according to claim 1, wherein the enameled wire of each frameless winding voice coil has a thickness in a range from 0.05 mm to 0.5 mm.

6. The vibration system of the ultra-thin full-range loudspeaker according to claim 1, wherein each enameled wire is a copper wire, an aluminum wire or a copper-clad aluminum wire.

7. An ultra-thin planar magnetic diaphragm full-range loudspeaker comprising the vibration system according to claim 1.

8. The vibration system of the ultra-thin full-range loudspeaker according to claim 1, wherein the diaphragm is formed of a flexible flat material.

9. The vibration system of the ultra-thin full-range loudspeaker according to claim 8, wherein the flexible flat material is an electrically insulating material.

10. The vibration system of the ultra-thin full-range loudspeaker according to claim 1, wherein the width of the flat wire is less than or equal to one-half of the thickness of the flat wire.

11. The vibration system of the ultra-thin full-range loudspeaker according to claim 1, wherein the enameled wire of each frameless winding voice coil has a width in a range from 0.05 mm to 0.5 mm.

12. The vibration system of the ultra-thin full range loudspeaker according to claim 1, wherein each of the plurality of windings directly contacts at least one other winding among the plurality of windings in a direction parallel to the plane of the diaphragm.

* * * * *